United States Patent [19]

Kittle

[11] 4,438,660

[45] Mar. 27, 1984

[54] DUAL MODE CONTROL LEVER ASSEMBLY

[75] Inventor: Carl E. Kittle, Cedar Falls, Iowa

[73] Assignee: Deere & Company, Moline, Ill.

[21] Appl. No.: 307,704

[22] Filed: Oct. 2, 1981

[51] Int. Cl.[3] ..... G05G 5/06

[52] U.S. Cl. ..... 74/531; 267/150

[58] Field of Search ..... 74/527, 529, 531; 267/150

[56] References Cited

U.S. PATENT DOCUMENTS

| | | | |
|---|---|---|---|
| 2,924,680 | 2/1960 | Swenson | 200/61.3 |
| 3,721,160 | 3/1973 | Kittle | 91/426 |
| 3,779,096 | 12/1973 | Hurst et al. | 74/476 |
| 3,963,051 | 6/1976 | Kuhlmann | 137/637 |
| 4,038,508 | 7/1977 | Mapelsden | 74/531 X |
| 4,215,771 | 8/1980 | Huitema | 192/3.54 |
| 4,222,474 | 9/1980 | Choudhury et al. | 192/0.096 |
| 4,259,878 | 4/1981 | Anderson | 74/491 |

OTHER PUBLICATIONS

Exhibit Relating to Control Levers manufactured by OEM Controls, Inc. (4 pages), Jun. 1974.

*Primary Examiner*—Leslie A. Braun
*Assistant Examiner*—Frank McKenzie

[57] ABSTRACT

A control lever assembly includes a housing with a pivot member rotatably mounted therein on a pivot pin. A pair of cam members are pivotally mounted on the pivot pin adjacent opposite sides of the pivot member. One cam member is frictionally coupled to the housing. The other cam member is biased to a neutral position by a centering spring. A cross arm is movable in the pivot member to alternately couple and uncouple one or the other of the cam members from the pivot member, depending upon the energization state of a mode-select solenoid. A detent follower releasably holds the pivot member in a displaced position when in the spring-centered mode. A rotary potentiometer coupled to the pivot member generates an electrical signal representing the position of the pivot member and a lever handle attached thereto.

33 Claims, 9 Drawing Figures

DUAL MODE CONTROL LEVER ASSEMBLY

BACKGROUND OF THE INVENTION

This invention relates to an operator-movable control lever assembly with a single lever having both friction-held and spring-centered operational modes It is well-known to use manual control levers to remotely control hydraulic functions such as hydraulic motors or cylinders. For example, friction-held control levers are used to remotely control implement hitches on agricultural vehicles wherein the control lever is moved to a friction-held displaced position to cause the hitch to raise or lower to a new position, corresponding to the displaced control lever position. A friction-held control lever is also used to control the rotation speed of hydraulic motors where the rotation speed is maintained at a value corresponding to the control lever position. Spring-centered and detent-held control levers are used to control a hydraulic function through a selective control valve, as described in U.S. Pat. No. 3,721,160. In such an application, the control lever is moved to a detent-held displaced position to hydraulically extend or retract a hydraulic cylinder. When the hydraulic cylinder is fully raised, the detent is automatically released, for example, by a pressure increase, and the lever returns to its neutral position under the influence of a centering spring, whereupon the cylinder is held in the extended or retracted position.

Where both friction-held and spring-centered operational modes have been required, it has heretofore been necessary to provide a separate friction-held control lever and a separate spring-centered control lever for each operational mode. This has been expensive and takes up valuable space on an operator's control panel. Therefore, it would be desirable to provide a single lever control lever assembly with multiple functional modes.

SUMMARY OF THE INVENTION

An object of the present invention is to provide a single lever control lever assembly with both friction-held and spring-centered operational modes.

Yet another object of the present invention is to provide a single lever dual operational mode control assembly with easy operator selection of modes.

Another object of the present invention is to provide a dual mode control lever with a detent for releasably holding the control lever in a displaced position.

Still another object of the present invention is to provide a single lever control assembly with dual function modes and which includes transducer means for providing a signal indicative of lever position.

The above objects and additional objects and advantages are achieved by the present invention which includes a housing, a pivot member rotatably mounted in the housing and a manually operable control lever fixed to the pivot member. A friction member and a centering member are pivotal in the housing adjacent opposite sides of the pivot member. The friction member carries friction disks which are biased into engagement with the housing to yieldably resist relative movement. A centering spring coupled between the housing and the centering member yieldably urge the centering member to a neutral position relative to the housing. A solenoid-driven mode select member moves in the pivot member to couple and uncouple the pivot member with the friction and centering members. The pivot member also includes detent recesses for receiving a solenoid-driven detent follower which will hold the pivot member in a displaced position and a series of gear teeth engaging a gear wheel of a rotary potentiometer which provides a signal indicative of pivot member positions.

DETAILED DESCRIPTION

Figure 1:
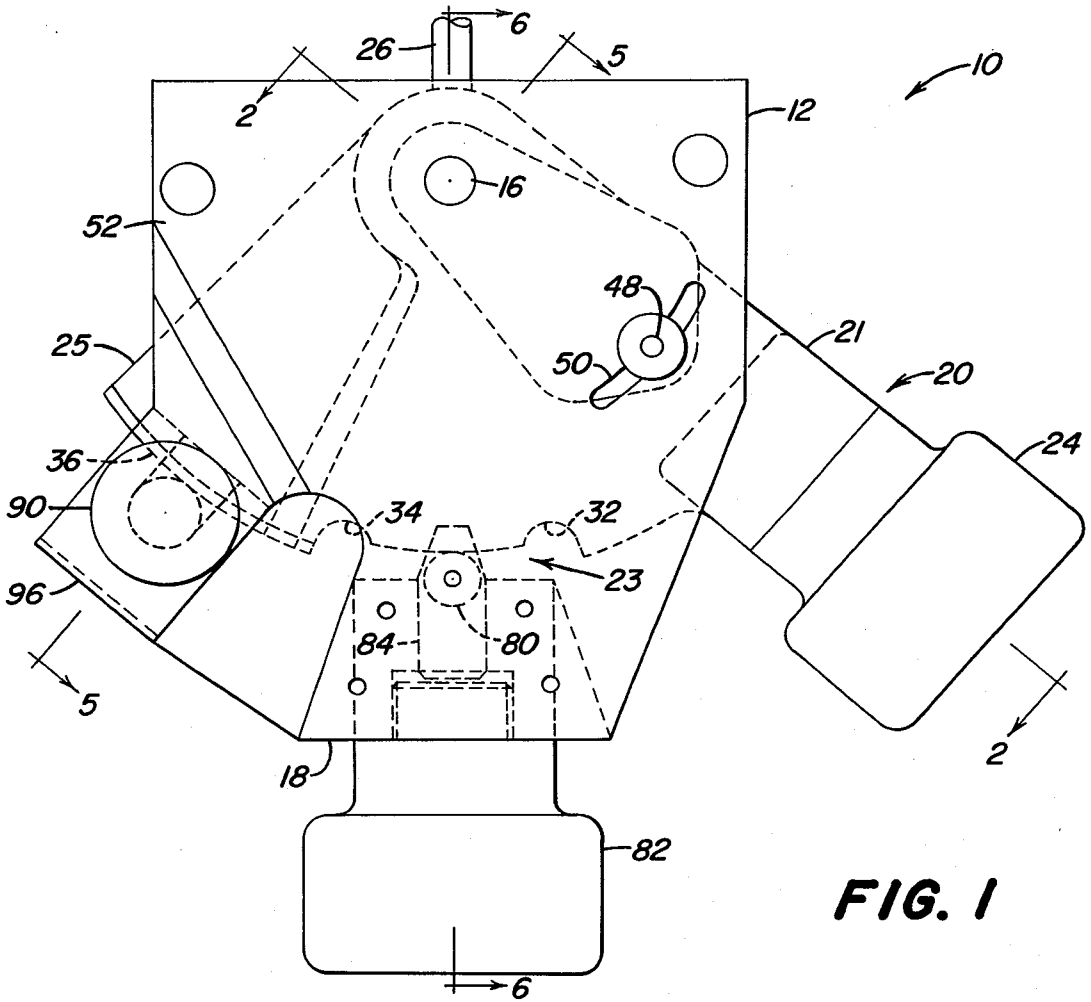
FIG. 1 is a side view of a control lever assembly constructed according to the present invention.
Figure 7:
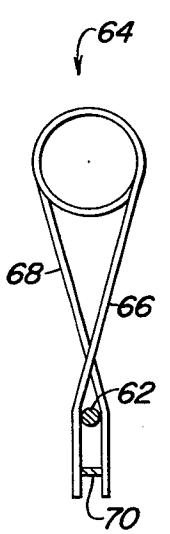
FIG. 7 is a view of the centering spring of the present invention.

A control lever assembly 10 includes housing sections 12 and 14 held together by a pivot pin 16 and a spacer block 18 to which the housing sections 12 and 14 are riveted or otherwise suitably attached. The housings 12 and 14 may be mounted in an operator-accessible location in a vehicle operator's compartment.

A segment-shaped, three-part pivot member 20 is pivotal in the housing on the pivot pin 16. A first part 21 of the pivot member 20 (best seen in FIGS. 1 and 2) includes a bore 22 which extends radially through the pivot member 20 from an end supporting a mode-select solenoid 24 to an opposite end into which is press-fitted, or otherwise suitably attached, an end of an operator-movable control lever or handle 26. Slots 28 and 30 extend through the sides of the pivot member 20 and intersect the bore 22. A second part 23 of the pivot member 20 includes a curved outer peripheral surface in which a pair of detent recesses 32 and 34 are formed. A third part 25 of the pivot member 20 has a rack of gear teeth 36 on its outer peripheral surface.

Cam members 38 and 40 are pivotal on the pivot pin 16 adjacent opposite sides of the first part 21 of pivot member 20. Cam member or friction member 38 includes a curved slot 42, a cam notch 44 and a pin-receiving bore 46. A pin 48 is press-fitted into the bore 46 and extends axially outward from the cam member 38 and through a slot 50 in the housing section 12. Friction disks 52 are mounted on the pin 48 on opposite sides of housing section 12 and are biased into sliding frictional engagement with the housing section 12 by Belleville washers 54 which act upon steel washer 53.

Cam member or centering member 40 includes a slot 56, a cam notch 58 and a pin-receiving bore 60, with the relative orientation of the slot 56 and notch 58 inverted from that of slot 42 and notch 44 of cam member 38. A pin 62 is press-fitted into bore 60 and extends through a slot 63 in housing section 14. A centering spring 64 includes a coil surrounding a bushing 65 on a portion of the pivot pin 16 and a pair of arms 66 and 68 engageable with the pin 62 and with a tab 70 formed by a portion of the housing 14.

A rod 72 is slidably received in the bore 22. A pair of rollers 74 and 75 are pinned to the rod 72. Rollers 74 and 75 are receivable by the slots 42 and 56 and by the notches 44 and 58 of the cam members 38 and 40, respectively. A spring 76 urges the rod radially away from the pivot pin 16. The solenoid 24 is threaded into an outer portion of the first pivot member part 21 and may be energized to move the rod 72 upward viewing FIG. 2, against the force of the spring.

A detent roller 80 is rotatably supported on a follower 84 which is slidably received in a bore 86 extending through the spacer 18. The roller 80 is normally lightly biased into engagement with the peripheral surface of pivot member second part 23 by a spring (not shown) internal to a detent solenoid 82 threadably mounted on the spacer 18. The detent solenoid 82 may be energized to urge the roller 80 towards the second part 23.

Figure 5:
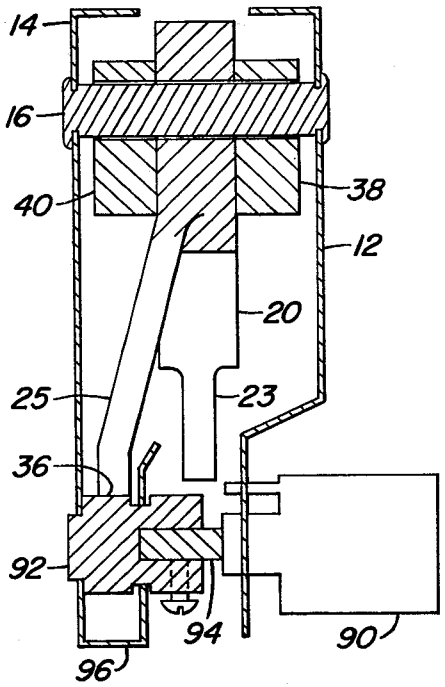
FIG. 5 is a partial sectional view taken along lines 5—5 of FIG. 1 with portions of the background omitted for clarity.
Figure 3:
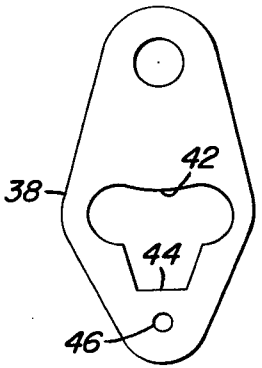
FIG. 3 is a view of the inside face of the friction member of the present invention.
Figure 4:
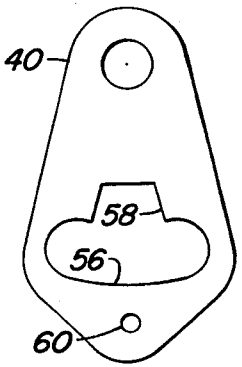
FIG. 4 is a view of the inside face of the centering member of the present invention.

A rotary potentiometer 90 includes a housing 91 which is non-rotatably attached to housing part 12, as best seen in FIG. 5. A gear wheel 92 is fixed for rotation with the potentiometer shaft 94. The gear wheel 92 is rotatably supported by bores in a folded-over portion 96 of the housing part 14. The gear wheel 92 meshes with the gear teeth 36 of pivot member part 25 so that potentiometer shaft 94 rotates when the pivot member 20 and the control lever handle 26 are pivoted about pivot pin 16. Thus, the potentiometer 90 provides an electrical signal representing the position of the control lever 26. Alternatively, information concerning the position of lever 26 may be communicated via a mechanical linkage, (not shown), which could then be connected to the swash plate of a variable speed motor, (not shown), or to the spool of a selective control valve, (not shown).

MODE OF OPERATION

Figure 2:
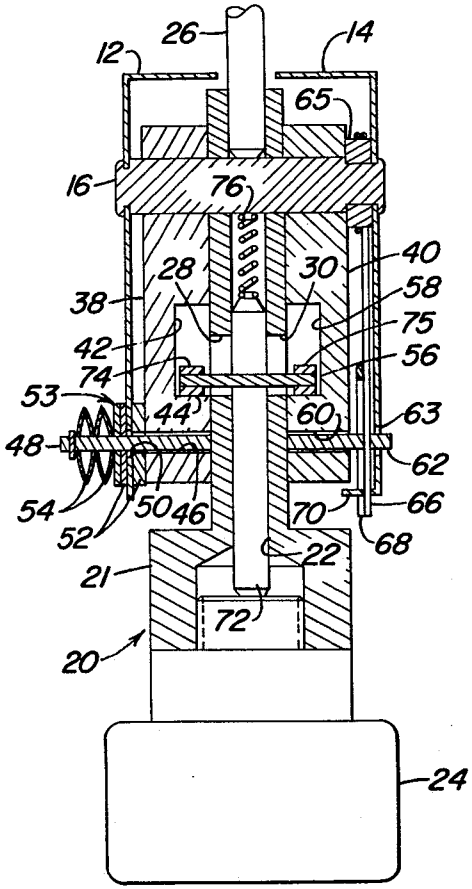
FIG. 2 is a partial sectional view taken along lines 2—2 of FIG. 1 with portions of the background omitted for clarity.
Figure 8:
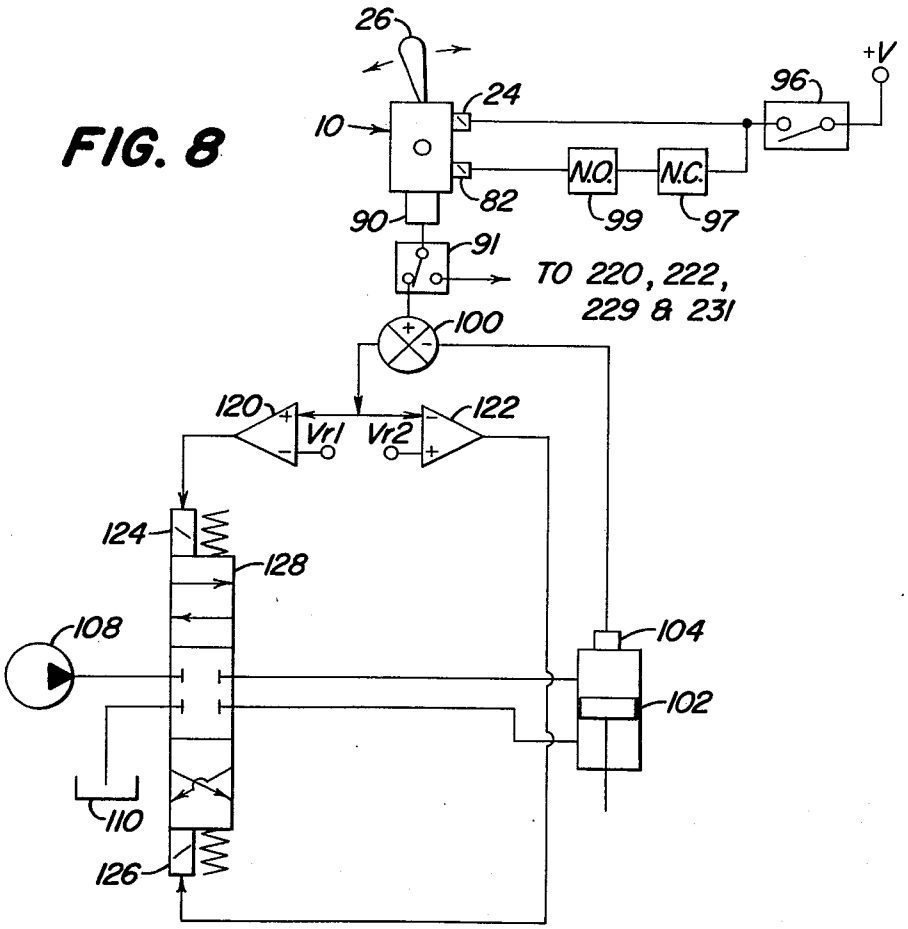
FIG. 8 is a schematic view of a system utilizing the friction-held operational mode of the present invention.

The friction-held operational mode may be best understood with reference to FIG. 8. The system shown in FIG. 8 is merely exemplary and forms no part of the present invention. In this operational mode, a switch 96 is operated to de-energize mode-select solenoid 24 and detent solenoid 82. A normally closed pressure-operated switch 97 and a normally open voltage-operated switch 99 are connected between switch 96 and solenoid 82, but are inoperative in this friction-held mode. When the mode-select solenoid 24 is not energized, as shown in FIG. 2), the spring 76 urges the rod 72 and the roller 74 downward, (viewing FIG. 2), so that roller 74 is received by notch 44 of cam member 38 while the roller 75 is received by slot 56 of cam member 40. Thus, the pivot member 20 is effectively disengaged or uncoupled from cam member 40 and centering spring 64, but the cam member 38 is coupled for pivotal movement with pivot member 20. Thus, when the operator moves handle 26 to a new position, the pivot member 20 and control lever handle 26 are held in that new position by the frictional engagement of friction disks 52 with the housing section 12. The detent solenoid 82 is de-energized so that the detent mechanism does not interfere with this operation. In this case, the potentiometer 90 generates a control signal which is communicated via a function-select switch 91 to an input of an error detector or difference generator 100. The other input of error detector 100 receives a position feedback signal from a hydraulic cylinder 102 with a position transducer 104. An example of such a cylinder may be found in U.S. Pat. No. 3,726,191. The error signal from error detector 100 is applied to the inputs of comparators 120 and 122. Depending upon which direction the lever 26 is pivoted, this will generate a positive or negative error signal from error detector 100 which, in turn, changes either comparator 120 or 122, respectively, from its normally low condition to a high output condition. Slightly positive and negative reference voltages Vr1 and Vr2 are applied to the (−) and (+) inputs of comparators 120 and 122, respectively, to provide a deadband operational region. This causes energization of either solenoid 124 or 126 of solenoid-operated directional control valve 128, causing retraction or extension, respectively, of cylinder 102 by controlling fluid communication from the pump 108 and the sump or reservoir 110. When the cylinder 102 moves to a position corresponding to the position of control lever 26, the error signal from detector 100 goes to zero, both comparators 120 and 122 go low and the valve 128 returns to its center position to prevent further movement of cylinder 102 until the control lever 26 is moved again.

Figure 9:
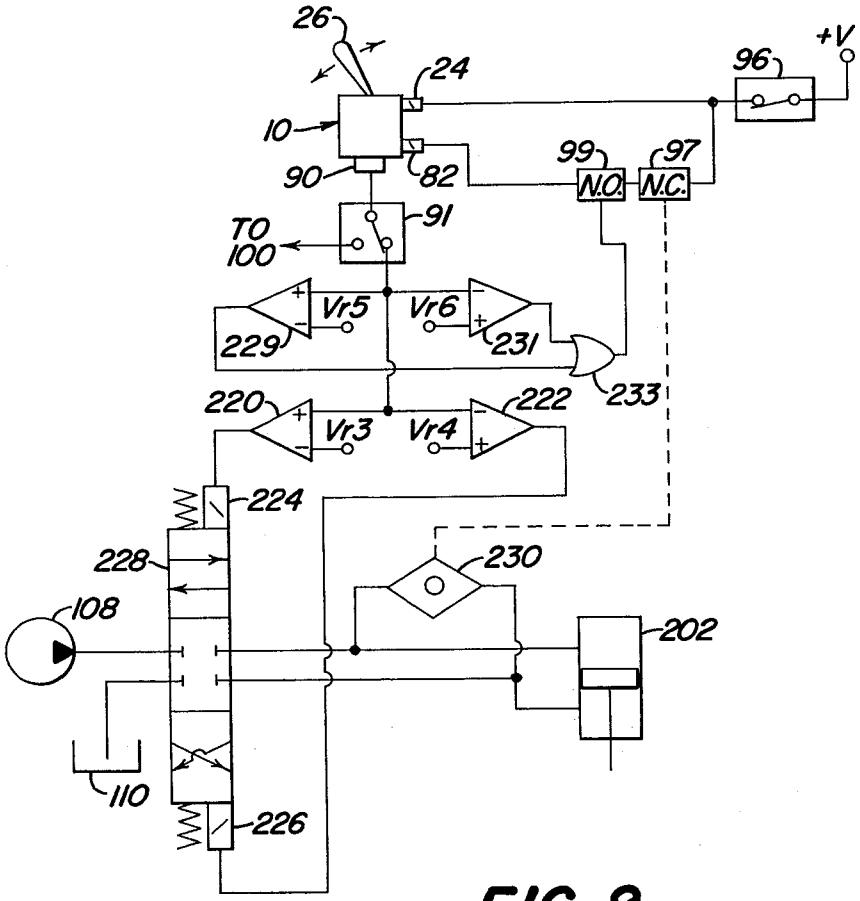
FIG. 9 is a schematic view of a system utilizing the spring-centered operational mode of the present invention.
Figure 6:
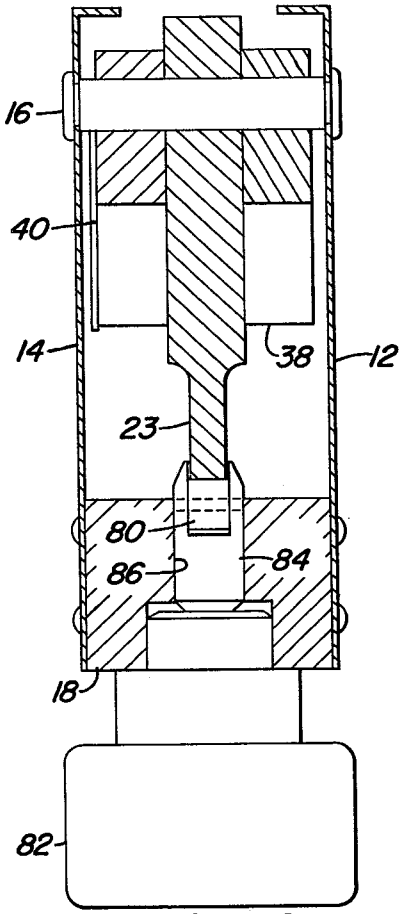
FIG. 6 is a partial sectional view taken along lines 6—6 of FIG. 1 with portions of the background omitted for clarity.

The spring-centered operational mode may best be understood with reference to the system shown in FIG. 9. This system is also merely exemplary and forms no part of the present invention. In this operational mode, switch 96 is operated to apply voltage to switch 97 and to energize mode-select solenoid 24 and function-select switch 91 is positioned to connect potentiometer 90 to comparators 220, 222, 229 and 231. When the mode-select solenoid 24 is energized, then the rod 72 and the rollers 74 and 75 are moved upward against the bias of spring 76, and rollers 74 is received by slot 42 of cam member 38 while roller 75 is received by notch 58 of cam member 40. In this case, the pivot member 20 is uncoupled from the cam member 38 and the friction disks 52, but the cam member 40 is coupled for pivotal movement with the pivot member 20. Now, when the handle 26 is moved from its neutral position, the cam member 40 pivots with it, causing the pin 62 to move with respect to tab 70, thus separating the arms of centering spring 64. Once the handle 26 is released by the operator, it will return to its neutral position under the influence of centering spring 64.

Depending upon which direction the lever 26 is pivoted, either comparator 220 or 222 changes to a high output condition from its normally low condition, depending upon the relationship between the signal from the potentiometer 90 and reference signals Vr3 and Vr4. Depending upon which of the comparators 220 or 222 goes high, then either solenoid 224 or 226 of solenoid-operated directional control valve 228 is energized, causing retraction or extension, respectively, of cylinder 202.

If the handle 26 and the pivot member are pivoted far enough in either direction, for example, 85% of full travel, then the voltage from potentiometer 90 will turn on either of comparators 229 or 231, depending upon the relationship of the potentiometer voltage to reference voltages Vr5 and Vr6, which represent +85% and −85% or lever pivoting, respectively. This causes OR gate 233 to go high to close normally open electrically operated switch 99. Now, current can flow through switches 97 and 99 to energize detent solenoid 82 to hold roller 80 in one of the detent recesses 32 or 34. In this case, the detent roller 80 will hold the pivot member 20 and the control handle 26 in the displaced position, despite the effect of centering spring 64.

When the cylinder 202 reaches the end of its stroke, a pressure buildup on either side of its piston is communicated via check valve 130 to open a normally closed pressure-operated switch 97. Parameters other than pressure, such as time or fluid flow, could be utilized to determine the proper time to open switch 97. The opening of switch 97 de-energizes detent solenoid 82 to release the detent mechanism and allow lever 26 to return to its neutral position under the influence of centering spring 64, whereupon both comparators 220 and 222 are low, whereupon both comparators turn off to permit switch 99 to open, and the valve 226 returns to its center position to prevent further movement of cylinder 203 until the control lever is moved again.

Thus, the foregoing detailed and operational description describes a single lever control lever assembly which has both a friction-held operational mode and a detent-held, spring-centered operational mode. Furthermore, while the foregoing description relates to a preferred embodiment of the invention, it should be understood that various changes and modifications may be made without departing from the scope of the invention, as set forth in the following claims.

I claim:

1. A control lever assembly comprising:

a housing;

an operator-movable control lever;

pivot means for pivotally supporting the control lever in the housing;

friction means for frictionally coupling the control lever to the housing and yieldably resisting relative motion therebetween;

resilient means biased to urge the control lever from a displaced position to a neutral position, relative to the housing; and a selecting member movable between a first position wherein it couples the control lever to the friction means while uncoupling the control lever from the resilient means, and a second position wherein it couples the control lever to the resilient means while uncoupling the control lever from the friction means.

2. The invention of claim 1, further comprising:

transducer means responsive to movements of the control lever for generating signals representing the position of the control lever relative to the housing.

3. The invention of claim 1, further comprising:

solenoid means operatively connected to the selecting member and responsive to operator-selected control signals for moving the selecting member between its first and second positions.

4. The invention of claim 1, wherein:

the friction and resilient means are pivotally mounted on the pivot means adjacent opposite sides of the control lever.

5. A control lever assembly comprising:

a housing;

an operator-movable control lever;

pivot means for pivotally supporting the control lever in the housing;

friction means for frictionally coupling the control lever to the housing and yieldably resisting relative motion therebetween;

resilient means biased to urge the control lever from a displaced position to a neutral position, relative to the housing;

detent means for releasably holding the control lever in the displaced position; and a selecting member movable between a first position wherein it couples the control lever to the friction means while uncoupling the control lever from the resilient means, and a second position wherein it couples the control lever to the resilient means while uncoupling the control lever from the friction means.

6. The invention of claim 5, further comprising:

first solenoid means operatively connected to the selecting member for moving the selecting member between its first and second positions; and a second solenoid means operatively connected to the detent means for moving the detent means towards and away from the control lever.

7. The invention of claim 6, wherein:

the first solenoid means is coupled for pivotal movement with the control lever.

8. The invention of claim 5, wherein:

the friction means and the resilient means are pivotally mounted on the pivot means adjacent opposite sides of the control lever.

9. A control lever assembly comprising:

a housing;

an operator-movable control lever fixed to a pivot member, the pivot member having a radially extending bore therein and a transverse opening intersecting the bore;

pivot means for pivotally supporting the pivot member in the housing;

friction means for frictionally coupling the control lever to the housing and yieldably resisting relative motion therebetween;

resilient means biased to urge the control lever from a displaced position to a neutral position relative to the housing; and a selecting member movable between a first position wherein it couples the control lever to the friction means while uncoupling the control lever from the resilient means, and a second position wherein it couples the control lever to the resilient means while uncoupling the control lever from the friction means, the selecting member including a rod slidably received by the bore and a cross arm fixed to the rod and extending through the opening to first and second ends engageable and disengageable with the friction and resilient means upon movement of the rod in the bore.

10. The invention of claim 9, wherein:

the friction means includes a friction member pivotally mounted on the pivot means, the friction member having a slot slidably receiving the first arm end when the pivot member and friction member are uncoupled, having a notch receiving the first arm end when the pivot and friction members are coupled together, and having a friction element projecting therefrom and biased into sliding engagement with the housing.

11. The invention of claim 9, wherein:

the resilient means comprises a centering member pivotally mounted on the pivot means, the centering member having a slot slidably receiving the second arm end when the pivot member and centering member are uncoupled, a notch receiving the second arm end when the pivot and centering member are coupled together, and a centering spring coupled between the housing and the centering member and biased to urge the centering member from a displaced to a neutral position.

12. The invention of claim 9, wherein:

the friction means includes a friction member pivotally mounted on the pivot means, the friction member having a slot slidably receiving the first arm end when the pivot member and friction member are uncoupled, having a notch receiving the first arm end when the pivot and friction members are coupled together, and having a friction element projecting therefrom and biased into sliding engagement with the housing; and the resilient means comprising a centering member pivotally mounted on the pivot means, the centering member having a slot slidably receiving the second arm end when the pivot member and centering member are uncoupled, a notch receiving the second arm end when the pivot and centering member are coupled together, and a centering spring coupled between the housing and the centering member and biased to urge the centering member from a displaced to a neutral position.

13. The invention of claim 5, further comprising:

transducer means mounted on the housing and operatively engaging the control lever for generating signals representing the position of the control lever relative to the housing.

14. A control lever assembly comprising:

a housing;

an operator-movable control lever;

pivot means for pivotally coupling the control lever and the housing;

a first member pivotally coupled to the housing;

friction means for frictionally coupling the first member to the housing to yieldably resist relative motion therebetween;

a second member pivotally coupled to the housing;

a resilient member coupled between the second member and the housing and biased to urge the second member from a displaced position to a neutral position relative to the housing; and a third member movable between a first position wherein it couples the first member for movement with the control lever while uncoupling the second member from the control lever and a second position wherein it couples the second member for movement with the control lever while uncoupling the first member from the control lever.

15. The invention of claim 14, wherein:

the third member includes a body slidably received in a bore which extends longitudinally in the control lever and a cross arm fixed to the body and having ends projecting axially from opposite sides of the control lever, each end being engageable and disengageable with a corresponding one of the first and second members.

16. The invention of claim 15, wherein:

the first member includes an arcuately-shaped recess for receiving one end of the cross arm when the third member is in its second position and a walled notch for receiving the one end of the cross arm, the walls of the notch engaging the one end of the cross arm to prevent relative movement therebetween when the third member is in its first position.

17. The invention of claim 15, wherein:

the second member includes an arcuately-shaped recess for receiving the other end of the cross arm when the third member is in its first position and a walled notch for receiving the other end of the cross arm, the walls of the notch engaging the other end of the cross arm to prevent relative movement therebetween when the third member is in its second position.

18. The invention of claim 15, wherein:

the first member includes an arcuately-shaped recess for receiving one end of the cross arm when the third member is in its second position and a first walled notch for receiving the one end of the cross arm, the walls of the first notch engaging the one end of the cross arm to prevent relative movement therebetween when the third member is in its first position; and the second member includes an arcuately-shaped recess for receiving the other end of the cross arm when the third member is in its first position and a second walled notch for receiving the other end of the cross arm, the walls of the second notch engaging the other end of the cross arm to prevent relative movement therebetween when the third member is in its second position.

19. The invention of claim 14, wherein:

the housing includes an arcuate-shaped aperture therein, the first member including a body pivotally mounted in the housing and a pin extending through the aperture and extending axially away from the body, the friction means being mounted on the pin and being frictionally and slidably engageable with portions of the housing surrounding the aperture.

20. The invention of claim 14, wherein:

the second member includes a body pivotally mounted in the housing and a finger projecting axially away from the body, the housing including a lug projecting away therefrom and towards the body of the second member, the resilient member having a coil portion surrounding the pivot means and first and second arms projecting from the coil portion and biased to engage with the finger and the lug to thereby urge the second member to the neutral position.

21. The invention of claim 14 further comprising:

detent means for releasably holding the control lever in the displaced position.

22. The invention of claim 14, further comprising:

resilient means coupled between the pivot means and the third member and biased to urge the third member to one of its first and second positions, and actuator means for moving the third member to the other of its first and second positions in response to an operator command.

23. The invention of claim 14, wherein:

a common pivot pin comprises the pivot means and pivotally couples the first and second members to the housing.

24. The invention of claim 14, wherein:

the first and second members are disposed adjacent opposite sides of the control lever.

25. The invention of claim 14, wherein:

a detent follower is reciprocally mounted in the housing, the control lever includes first and second segment-shaped arms, the first arm having a curved outer peripheral surface having a detent recess therein for receiving the detent follower to releasably hold the control lever in its displaced position and the second arm having means on an outer peripheral surface thereof for operatively engaging a transducer for generating signals representing the position of the control lever.

26. The invention of claim 25, further comprising:

detent actuator means responsive to detent control signals for moving the detent follower towards the control lever and into the detent recess and for moving the detent follower away from the control lever and out of the detent recess.

27. A multiple mode control lever assembly comprising:

a housing;

a pivot member pivotally mounted in the housing and including a first part having a radial bore extending therethrough and an opening extending axially through the first part and intersecting the radial bore and a second part having a detent recess in a peripheral surface thereof;

an operator-movable control lever fixed for pivotal movement with the pivot member;

a friction member pivotal in the housing;

friction means yieldably resisting relative movement between the pivot member and the housing;

a centering member pivotal in the housing;

a resilient member coupled between the housing and the centering member biased to urge the centering members from a displaced position to a neutral position relative to the housing;

a detent member supported on the housing biased towards the pivot member and receivable in the detent recess to releasably hold the pivot member in a displaced position; and a selecting member including a rod slidably received in the radial bore in the pivot member first part and a cross arm fixed to the rod and extending through the opening to first and second ends oppositely engageable and disengageable with the friction member and the centering member.

28. The invention of claim 27, further comprising:

transducer means responsive to movement of the pivot member for generating signals representing a position of the pivot member relative to the housing.

29. The invention of claim 28, wherein the means comprises:

a gear rack formed on a peripheral surface of pivot member;

a gear wheel rotatably supported on the housi for meshing engagement with the gear rack; and a rotary potentiometer mounted on the housing having a shaft fixed for rotation with the gear wheel.

30. The invention of claim 27, further comprising:

first solenoid means operatively connected rod of the selecting member for reciprocally moving the rod the bore, and second solenoid means fixed to the housing operatively connected to the detent follower for moving the follower out of the detent recess.

31. A control lever assembly comprising:

a housing;

an operator-movable control lever fixed to a pivot member, the pivot member including a first part having a radial bore extending therethrough and an opening extending axially through the first part and intersecting the radial bore, a second part having a detent recess in a peripheral surface thereof, and a third part having a track of gear teeth formed thereon;

pivot means for pivotally supporting the pivot member in the housing;

a selecting member movable in the bore in the pivot member between first and second positions, the selecting member including a rod slidably received by the bore and a cross arm fixed to the rod and extending through the opening to first and second ends;

a friction member pivotally mounted on the pivot means, the friction member having a slot slidably receiving the first arm end when the pivot member and friction member are uncoupled, having a notch receiving the first arm end when the pivot and friction members are coupled together, and having a friction element projecting therefrom and biased into sliding engagement with the housing;

a centering member pivotally mounted on the means, the centering member having a slot slidably receiving the second arm end when the pivot member and centering member are uncoupled, a notch receiving the second arm end when the pivot and centering members are coupled together, and a centering spring coupled between the housing and the centering member and biased to urge the centering member from a displaced to a neutral position;

a detent follower reciprocal in the housing for being releasably received by the detent recess to releasably hold the control lever in its displaced position;

a detent spring biased to urge the detent follower into the detent recess;

first solenoid means operatively connected to the rod of the selecting member for reciprocally moving the rod in the bore;

second solenoid means fixed to the housing and operatively connected to the detent follower for moving the detent follower out of the detent recess; and transducer means responsive to movement of the pivot member for generating signals representing a position of the pivot member relative to the housing, the transducer means including a rotary potentiometer mounted in the housing and having a rotatable shaft and a gear wheel fixed to the shaft for meshing engagement with the gear rack.

32. The invention of claim 31, wherein:

the housing includes an arcuate-shaped aperture therein, the friction member including a body pivotally mounted in the housing and a pin extending through the aperture and extending axially away from the body, the friction element being mounted on the pin and being frictionally and slidably engageable with portions of the housing surrounding the aperture.

33. The invention of claim 31, wherein:

the centering member includes a body pivotally mounted in the housing and a finger projecting axially away from the body, the housing including a lug projecting away therefrom and towards the body, the centering spring having a coil portion surrounding the pivot means and first and second arms projecting from the coil portion and biased to engage with the finger and the lug to thereby urge the centering member to the neutral position.

* * * * *

UNITED STATES PATENT AND TRADEMARK OFFICE

CERTIFICATE OF CORRECTION

PATENT NO. : 4,438,660

DATED : 27 March 1984

INVENTOR(S) : Carl Edwin Kittle

It is certified that error appears in the above-identified patent and that said Letters Patent is hereby corrected as shown below:

Column 9, line 46, after "the", insert -- transducer --; line 48, after "of", insert -- the --; line 50, delete "housi" and insert -- housing --; line 52, after "housing", insert -- and --; line 55, after "connected", insert -- to the --; line 56, after "rod", insert -- in --; line 58, after "housing", insert -- and --; and line 60, after "the" (first occurrence), insert -- detent --.

Column 10, line 20, after "the", insert -- pivot --.

Signed and Sealed this

First Day of January 1985

[SEAL]

*Attest:*

GERALD J. MOSSINGHOFF

*Attesting Officer*

*Commissioner of Patents and Trademarks*